United States Patent [19]

Sirel

[11] 4,249,300

[45] Feb. 10, 1981

[54] METHOD OF MANUFACTURING A CIRCULAR WAVE GUIDE AND INSTALLING THE SAME

[75] Inventor: Michel Sirel, Paris, France

[73] Assignee: Les Cables de Lyon, Lyon, France

[21] Appl. No.: 912,141

[22] Filed: Jun. 2, 1978

[30] Foreign Application Priority Data

Jun. 10, 1977 [FR] France ..... 77 17816

[51] Int. Cl.[3] ..... H01P 11/00

[52] U.S. Cl. ..... 29/600; 156/175; 156/86

[58] Field of Search ..... 333/95 R, 95 A; 29/600, 29/235, 234; 156/175, 86

[56] References Cited

U.S. PATENT DOCUMENTS

| | | | |
|---|---|---|---|
| 3,290,762 | 12/1966 | Ayuzawa et al. | 29/600 |
| 3,492,607 | 1/1970 | Effemey | 333/95 R |
| 4,035,534 | 7/1977 | Nyberg | 156/86 |

FOREIGN PATENT DOCUMENTS

| | | | |
|---|---|---|---|
| 447964 | 4/1948 | Canada | 333/95 A |
| 2125072 | 12/1971 | Fed. Rep. of Germany . | |
| 1030522 | 3/1953 | France . | |
| 2193267 | 11/1973 | France . | |
| 485948 | 5/1938 | United Kingdom . | |
| 523007 | 7/1940 | United Kingdom . | |
| 768753 | 2/1957 | United Kingdom . | |
| 837462 | 6/1960 | United Kingdom . | |
| 845241 | 8/1960 | United Kingdom . | |
| 943840 | 12/1963 | United Kingdom . | |
| 1031992 | 1/1973 | United Kingdom . | |

*Primary Examiner*—Milton S. Mehr

*Attorney, Agent, or Firm*—Sughrue, Rothwell, Mion, Zinn and Macpeak

[57] ABSTRACT

A circular wave guide for transmitting the $TE_{11}$ mode of propagation is manufactured such that it is suitable for winding on a drum. During manufacture, a flexible thin-walled conductive tube is reinforced by an outer protective covering of plastic material and by an inner reinforcing member also of plastic material. The inner reinforcing member may be of tubular cross-section as shown, or may have some other cross-section, e.g. cruciform. The inner reinforcing member may be made of a material which shrinks on heating so that it can be removed once the wave guide has been unwound from the drum employed during transport. The conductor tube may be periodically intended to improve its flexibility.

1 Claim, 3 Drawing Figures

METHOD OF MANUFACTURING A CIRCULAR WAVE GUIDE AND INSTALLING THE SAME

FIELD OF THE INVENTION

The present invention relates to a new form of continuously manufactured circular wave guide of arbitrary length.

BACKGROUND OF THE INVENTION

The mode of wave propagation therein is the $TE_{11}$ mode having field lines which are orthogonal to the walls which therefore do not need to be perfectly circular.

A circular wave guide for use with the $TE_{11}$ mode and which is over-dimensioned for this mode has two essential advantages over a rectangular wave guide for use with the $TE_{01}$ mode: its attenuation is less by a factor of about 2 or 3, thereby enabling the use of microwave transmission systems requiring less power or smaller aerials of lower gain for identical range; further the propagation of two perpendicular waves which are independent from each other instead of a single wave is equivalent to doubling the capacity of a connection or of halving the number of connections required.

Now, the present state of the art only makes it possible to manufacture circular wave guide components which are rigid, machined, and whose connecting flanges are fixed by welding or by brazing in a workshop. These rigid components are generally a few meters long, up to a maximum of six meters.

This rigidity and multiplicity of connecting flanges causes these types of realization to have several drawbacks from the electrical point of view (reflections from the flanges), from the mechanical point of view (no flexibility; transport, handling and installation difficulties) and from the point of view of economy (high manufacturing costs).

Preferred wave guides in accordance with the present invention overcome the above drawbacks.

The present invention provides a circular wave guide including a metal conductor tube, which is sufficiently flexible to be wound on a drum, and which is provided with mechanical reinforcing means against ovalizing deformation of its right cross-section, said reinforcing means being retained at least until the wave guide is installed in an operative position.

The flexibility obtained makes it possible to wind the wave guide on a drum in the same manner as a cable, yet nevertheless, in operation it is capable of conveying electromagnetic propagation with less loss than rigid guides.

Examples of the present invention are described below with reference to the accompanying drawings.

DESCRIPTION OF PREFERRED EMBODIMENTS

Figure 1:
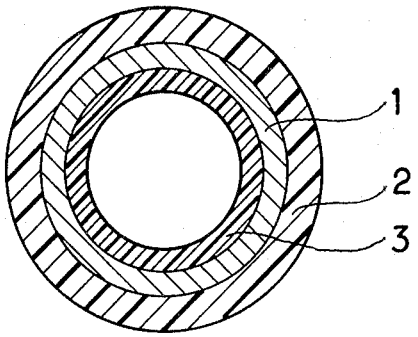
FIG. 1 is a transverse cross-section of a circular wave guide having an external covering and including an internal reinforcing tube.

The same items shown in several of the figures bear the same reference numerals in all of them.

As can be seen in FIG. 1, the wave guide includes a metal conductor tube 1 covered with a covering 2 of plastic material which is preferably glued to the metal tube. The covering 2 may be of polyethylene.

The metal tube 1 is manufactured by extrusion or by welding of a strip. The thickness of the tube may lie between half a millimeter and three millimeters. The material used may for example be an aluminum tube with a possible interior lining of copper. In the latter case, one of the tubes may be threaded inside the other and the assembly then drawn-down, or alternatively the copper may be deposited on sheets of aluminum which are then shaped to give them a circular form and which are then welded longitudinally.

In the example of FIG. 1, a reinforcing member of plastic material, e.g. polyethylene, has the shape of a tube 3 lining the inside of the conductor tube 1 and in contact therewith. The tube 3 should be a few millimeters thick, and preferably 3 millimeters thick.

Figure 2:
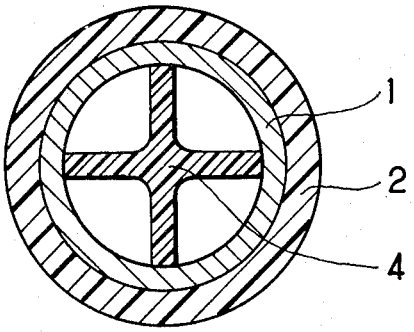
FIG. 2 is a transverse cross-section whose internal reinforcing member is cruciform in cross-section.

In the example of FIG. 2, the plastic material reinforcing member has a cruciform shape 4 and extends for the whole length of the wave guide. However, reinforcing members could be spaced out along the interior of the tube.

All these reinforcing members have the effect of keeping the wave guide properly round. In particular, if the plastic material is of the type which shrinks on heating (e.g. certain polyolefins), it is possible to remove the reinforcing member once the wave guide has been installed on site. It is possible to cause a draft of hot air from a generator to flow along the circular wave guide thereby shrinking the reinforcing member and allowing it to be removed.

It can be useful to remove the reinforcing member so as to reduce the attenuation of the circular wave guide.

Figure 3:
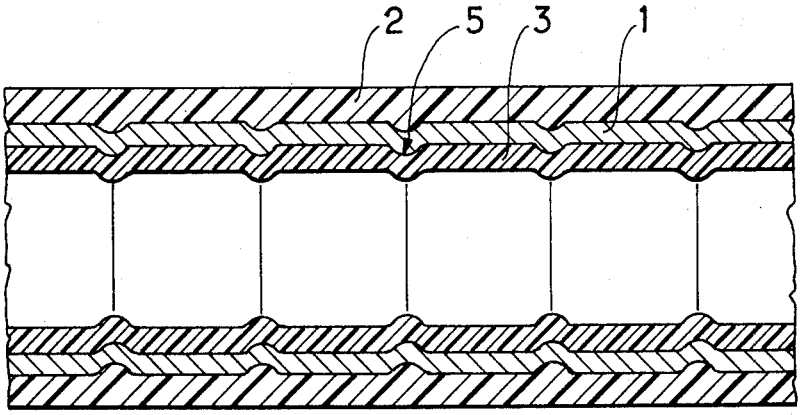
FIG. 3 is a longitudinal section of a wave guide of the type of FIG. 1 but including periodic indentations.

The reinforcing member is particularly useful in avoiding deformation of the conductor tube when the conductor tube is provided with periodic variations in its diameter as shown in FIG. 3, thereby constituting indentations 5. The indentations are to provide the conductor tube 1 with greater flexibility than that of a smooth tube.

The variants described of the cross-section of the reinforcing member are not limitative and its reduction is merely optional. There is no theoretical limit to the lengths of wave guide which can be manufactured in accordance with the invention. Lengths of one hundred meters are attainable.

The circular wave guide in accordance with the invention may be wound on a drum for transport to its point of use, where it is unwound and fitted to the exact convenient length between an aerial and a transmitter or a receiver. It may be connected to the equipment by means of circular-to-rectangular wave guide adaptors using contact-free connections as described in the Applicant's British Pat. No. 1,443,474.

I claim:

1. A method of manufacturing a circular wave guide and installing the same for the propagation of waves having field lines which are orthogonal to the wall and extending, in lengths greater than six meters, said wave guide comprising a metal conductor tube and a covering of plastic material, and being sufficiently flexible to be capable of being wound on a drum, said method comprising the steps of:

providing inside said metal conductor tube reinforcing means of tubular or cruciform shape formed of a plastic material shrinkable upon heating, before winding said wave guide on a drum and installing said wave guide in its final operative position, and heating said heat shrinkable reinforcing means by flowing internally of said tube and along said reinforcing means a draft of hot air, and removing said shrunk reinforcing means from the inside of said tube.

* * * * *